US005934943A

United States Patent [19]

McCarthy

[11] Patent Number: 5,934,943

[45] Date of Patent: Aug. 10, 1999

[54] ELECTRICAL CONNECTOR

[75] Inventor: Dale C. McCarthy, Pensacola, Fla.

[73] Assignee: Centerpin Technology, Inc., Gulf Breeze, Fla.

[21] Appl. No.: 08/999,356

[22] Filed: Dec. 29, 1997

Related U.S. Application Data

[63] Continuation-in-part of application No. 08/645,514, May 14, 1996, Pat. No. 5,704,814.

[51] Int. Cl.[6] ..... H01R 13/502

[52] U.S. Cl. ..... 439/695; 439/428

[58] Field of Search ..... 439/427, 428, 439/431, 461, 695

[56] References Cited

U.S. PATENT DOCUMENTS

| | | | |
|---|---|---|---|
| 916,313 | 3/1909 | Herrington | 439/428 |
| 3,097,035 | 7/1963 | Despard | 439/428 X |
| 3,633,147 | 1/1972 | Polidori | 439/428 X |
| 4,374,458 | 2/1983 | Komada | 439/427 X |
| 5,403,201 | 4/1995 | McCarthy | 439/427 |
| 5,704,814 | 1/1998 | McCarthy | 439/695 |

*Primary Examiner*—Khiem Nguyen

*Attorney, Agent, or Firm*—William M. Hobby, III

[57] ABSTRACT

An electrical connector for coupling to an insulated electrical conductor which includes a housing having a housing cover, said housing and cover each having a bore therein, one of which has a tapered portion and the other end of which has a flat end wall, electrical conductive prong, attached to said housing in the bore therein and extending axially into the housing bore for receiving the end of an insulated electrical conductor. Attaching means for attaching the housing cover to the housing. A compression collar having a bore extending axially therethrough for insertion of a wire therethrough and into the housing bore and onto the pointed prong extending thereinto. The compression collar having a flat surface at one end and an angled compression portion at the other end for wedging into the tapered portion of the one bore upon said cover being attached to the housing and being compressed upon driving the collar into the tapered portion of the bore whereby an insulated wire can be rapidly connected to an electrical connector without removing the insulation from the end thereof. The collar can be a one piece polymer member. The housing may have a plurality of bores each provided with a conductive prong and serviced by a corresponding plurality of compression collars for connecting a plurality of electrical conductors in the connector.

24 Claims, 3 Drawing Sheets

ELECTRICAL CONNECTOR

This invention is a continuation in part of previous patent application for Electrical Connector filed May 14, 1996, Ser. No. 08/645,514, now U.S. Pat. No. 5,704,814, dated Jan. 6, 1998.

BACKGROUND OF THE INVENTION

The present invention relates to electrical connectors and especially to an electrical connector for coupling to an insulated electrical conductor without stripping the end of the insulated electrical conductor.

In the past, a wide variety of electrical wire connectors have been provided for connecting to wire ends. In a typical connector, the end of the wire is stripped of insulation and the bare wire is inserted into a connector where it can be soldered or clamped or otherwise attached to the connector. It is also common to tin the wire ends by coating the wire end with solder and a wide variety of connectors have been provided which removably hold the wire to the connector.

Typical connectors are seen in audio systems, such as in hi-fi speakers in which a wire end is stripped of the insulation and is inserted in an opening and a threaded nut is threaded down onto the wire, the nut can be loosened for removing the wire. Other audio speakers include spring clamps which allows a wire end to be stripped of insulation and inserted into an opening while lifting the spring connector clamp and then releasing the spring connector clamp onto the wire. Relifting of the spring connector clamp allows the removal of the wire end. Other commonly used connectors allow a stripped wire end to be inserted into a connector or into both ends of a connector and then clamped with pliers to collapse a conductive sleeve onto the wire. This type of connector can be insulated or not as desired since it is made of a malleable metal in which the collapsing onto the stripped wire end provides the necessary electrical contact.

In contrast to these various types of wire connectors, the present invention deals with a wire connector that does not require the insulation to be stripped and also provides, in some embodiments, for the insertion of the insulated wire end in a manner to lock the wire end in place inside the bore of a wire connector.

Prior wire connectors can be seen in the following U.S. Patents. The Chang patent, U.S. Pat. No. 4,013,333, for a wire connector having two concentric sockets adapted to be assembled one into the other and in which the inner socket has a conductive needle mounted therein for sliding a wire end into each end of the connector and which also uses a spike pressed in two holes in the sleeves to penetrate the coating of the wire ends. In the U.S. patent to Danner, U.S. Pat. No. 3,860,320, a dangler cathode cable assembly is connected to a ball-like cathode member by stripping the end portion of the cable and inserting the end portion into a sleeve which is pressed into an undersized tapered socket and which has a pointed pin therein. In the U.S. patent to Friedhelm, U.S. Pat. No. 4,786,760, a cable connector for piezoelectric cable has an insulated cable end which is inserted into a sleeve. In the U.S. patent to Berman, U.S. Pat. No. 4,091,233, an electrical connector and a method of connecting an electrical cable to the connector is provided for connecting one or more insulated electrical cords or cables together. The insulated cable ends can be inserted into the receptacles on either end and onto a prong of electrically conductive material so that the prong is an electrical contact with the wire of an insulated cord end. A container of adhesive material on the end of the receptacle is released from the container to create a physical bond between the cord and the connector to hold the cord within the connector. In my prior U.S. Pat. No. 5,403,201 an electrical connector is coupled to an insulated electrical conductor without stripping the end of the insulated conductor. The insulated wire is held with a spring clamp which allows the wire to be released.

In the Komada U.S. Pat. No. 4,374,458 a method of connecting a co-axial cable to a connector having a plurality of connections. The Herrington U.S. Pat. No. 916,313 is for a spark plug having a spark plug wire connector on the end thereof. The Despard U.S. Pat. No. 3,097,035 is for another electric cable connector for use between sections of flexible multi-conductor cable as used with portable electric power consuming equipment and to a fixed power outlet. The Polidori U.S. Pat. No. 3,633,147 has a connector for underground utility applications.

The present invention utilizes an electrical connector for coupling to an insulated electrical conductor end which is inserted into a bore through a compression collar in a housing bore to drive a prong into the conductor end and to releasably clamp and hold the insulated wire end within the electrical connector with compression collar.

SUMMARY OF THE INVENTION

An electrical connector for coupling to a plurality of insulated electrical conductors includes a housing having a housing cover, said housing and cover having a plurality of bores therein, at least a portion of each bore having a tapered portion therein. A plurality of electrical conductive prongs, one of said of pointed prongs being attached to said housing in each bore therein and said pointed prong extending axially into each housing bore for receiving the end of an insulated electrical conductor. Attaching means for attaching the housing cover to the housing. A plurality of compression collars, each having a bore extending axially therethrough for insertion of a wire therethrough and into the housing bore and onto the pointed prong extending thereinto. Each collar has an angled compression portion thereon for wedging into the housing tapered portion upon said cover being attached to the housing and compressible upon driving the collar into the tapered portion of the bore whereby placing a plurality of insulated wires can be rapidly connected to an electrical connector without removing the insulation from the end thereof. The collar has the bore thereof tapered with an expandable and compressible end formed with a plurality of angled compression fingers and can be of different sizes so that different size wires can be inserted therethrough and guided onto the connector prong. The collar can be a one piece polymer or brass member.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
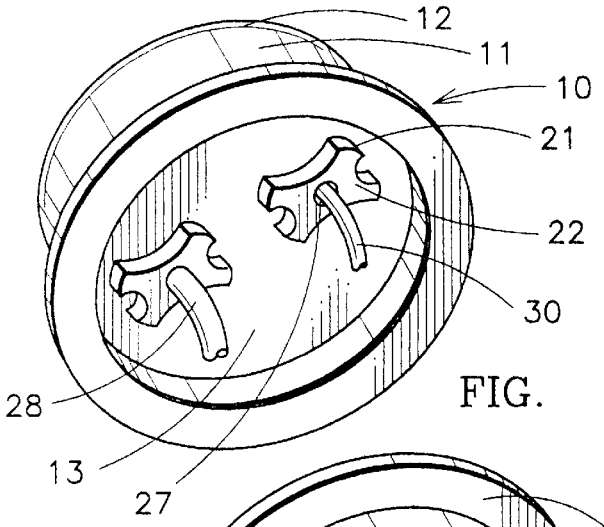
FIG. 1 is a perspective view of an electrical connector in accordance with the present invention.
Figure 2:
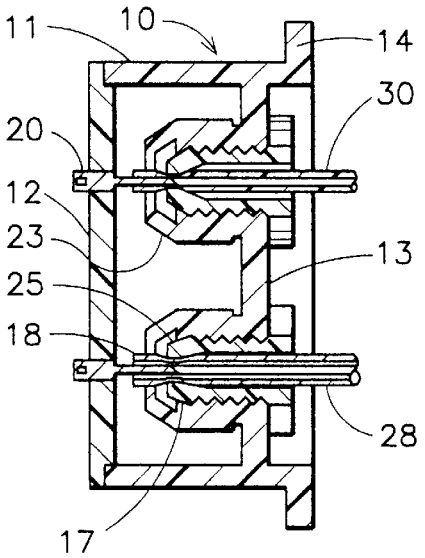
FIG. 2 is a sectional view taken through the electrical connector of FIG. 1.
Figure 3:
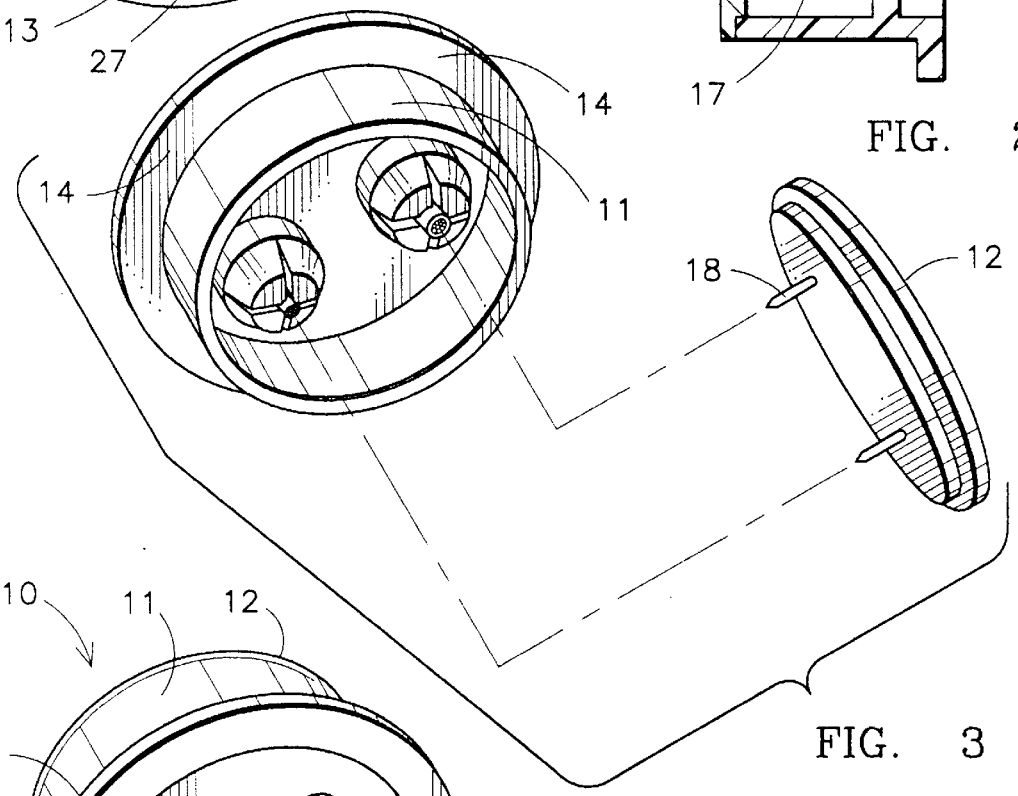
FIG. 3 is an exploded rear perspective view of the electrical connector of FIGS. 1 and 2.

Referring to the drawings and FIGS. 1–4, an electrical connector 10 has a housing 11 having a rear housing portion 12 and a front housing portion 13 having a flange 14 extending therearound. The housing may be made of a polymer or plastic material and the front housing piece 13 has a pair of threaded bores 15 extending therein having threads 16. The bores, as seen in FIG. 2, each have a tapered end portion 17 therein and an electrical connecting center pin or prong 18 extending therein from one end. The prong is attached to the rear cover 12 and has a wire connecting eye 20 extending out of the back 12 of the connector housing. A threaded collar member 21 has a handle 22 and external threads 23 which engage the internal threads 16 of the bores 15.

Figure 4:
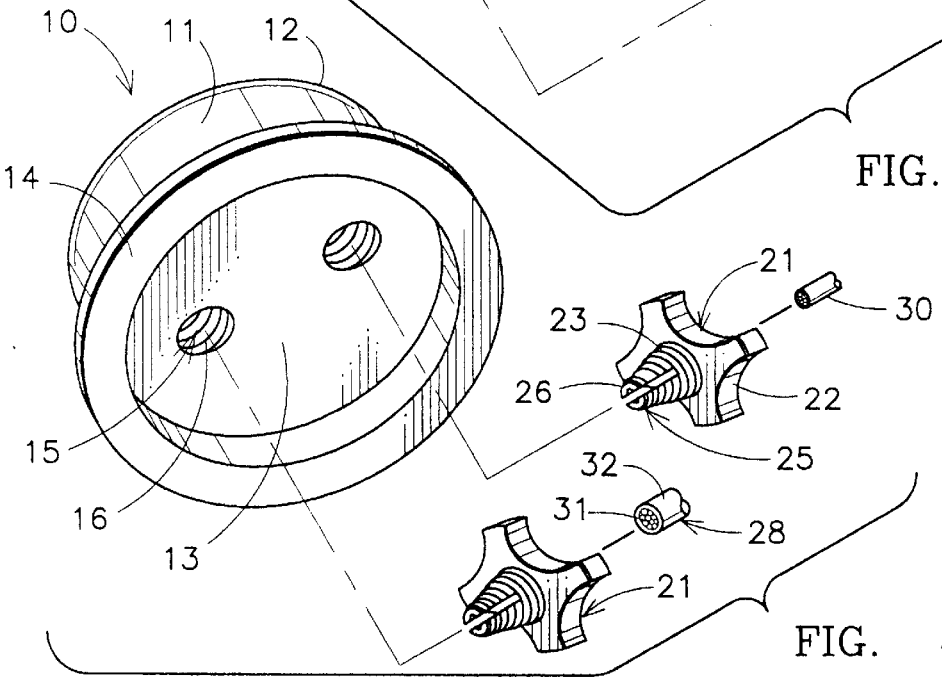
FIG. 4 is an exploded front perspective view of the electrical connector of FIGS. 1–3.

As seen in FIG. 4, each collar 21 has a threaded tapered end 25 having a plurality of slits 26 therein. The collar 21 can be made of a polymer material and has the slits 26 the tapered portion 25 to allow the collar to expand as different size wire is pushed through the collar bore 27 to guide the wire through the center of the collar 21 along the axis thereof. The wire is guided onto the center pin or protruding prong 18 so that the still insulated piece of wire can be inserted thereonto to provide an electrical connection. Once the wire is inserted, the electrical connection is made by sliding the conductor portion of the wire onto the connecting prong 18. The collar 21 handle 22 can be rotated to thread the external threads 23 further into the internal threads 16 so that the end 26 of the collar 21 is compressed by the angled surface 17 of the connector bore 15. As it pushes further in, the annular angled surface 17 compresses the split collar end 26 to clamp down onto the wire member 28 or 30 of FIG. 1 to firmly clamp the wire member into position extending onto the electrical connector.

In operation, a wire of any size, such as wires 28 or 30, can be inserted into the bore 27 until it is pushed onto the center pin 18 in the housing 11. The threaded collar 21 can then be rotated to compress the end 25 into the wedging or narrowing surface 17 to compress onto the wire 28 or 30 to lock the wire to the connector. Thus, a wide variety of wire sizes can be inserted into a universal electrical connector merely by sliding it into the bore 17 which makes the electrical contact without removing the insulation from the wire end and then clamping down upon the wire by rotating the collar handle 22. The wire can be removed simply by loosening the collar 21 by rotating the handle 22 in a counterclockwise direction to thereby loosen the compression of a collar end to allow the wire to be pulled loose.

The present connection is advantageous in situations such as in connecting of audio speakers where different size wires are frequently used including some of the larger cables. Thus, the electrical connector is universal as to a wide variety of wire sizes and allows the rapid connection of merely sliding the wire in and onto the center pin electrical connector conductor and, with a couple of twists of the collar, can threadedly lock clamp the cable onto the connector so that it cannot be easily pulled out without loosening the collar 21. The conductors 31 inside the insulation 32 of the wire 28 is thus guided directly onto the connector pin 18 for a complete electrical connection without removing any of the insulation 32 from the end of the wire 28.

Figure 5:
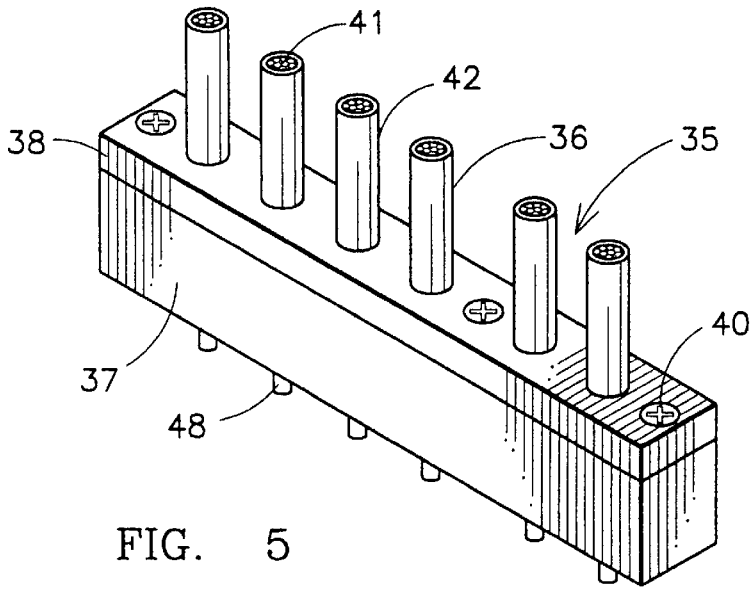
FIG. 5 is a perspective view of another electrical connector for connecting a plurality of conductors simultaneously thereto.
Figure 6:
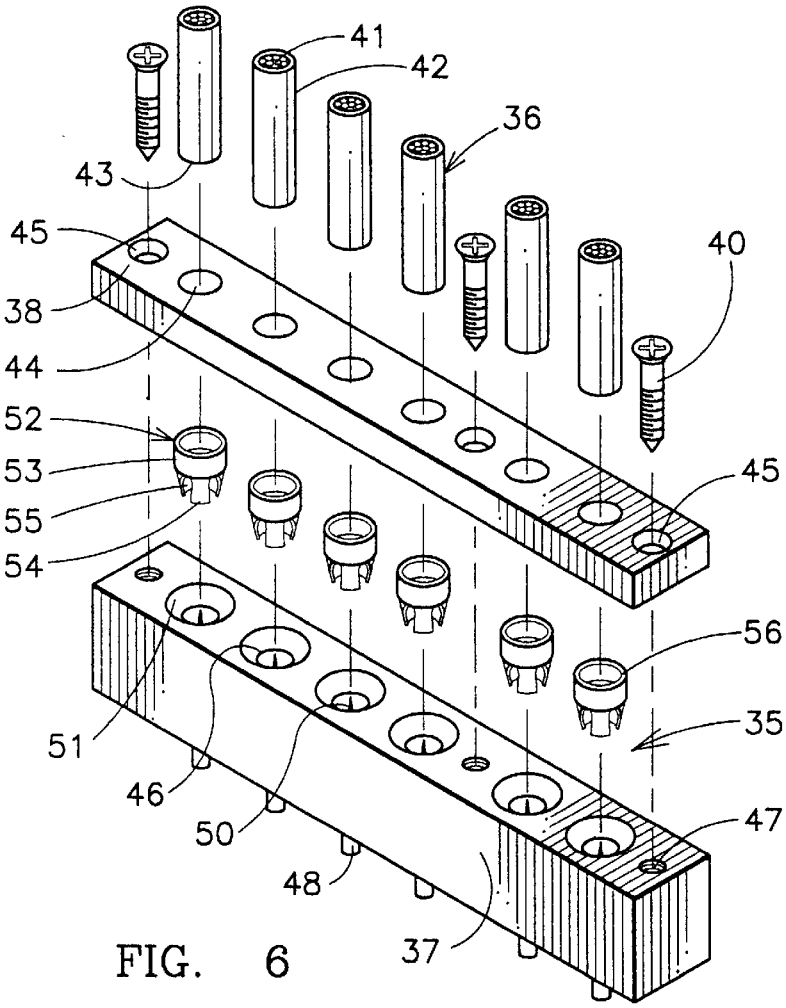
FIG. 6 is an exploded view of the connector of FIG. 5.

Referring to FIGS. 5 and 6, a multi-wire electrical connector 35 has a plurality of insulated conductors 36 attached thereto. An electrical connector 35 has a housing or body 37 in an elongated rectangular shape and has a cover 38 with a housing 37. The cover is attached to the housing with a plurality of threaded fasteners 40. Each electrical conductor 36 has a central conductor 41 surrounded by an insulating sheet 42. As seen in FIG. 6, each electrical wire 36 has been cut with a smooth edge 43 through the insulation and the conductor. The cover 38 has a plurality of openings 44 for inserting one conductor 36 within each opening 44. The cover also has the openings 45 for the screws 40. The housing in turn has a plurality of openings 46 which align with each opening 44 when the threaded fasteners 40 attach the cover 38 through the openings 45 and into the threaded openings 47. A plurality of electrical connectors 48 extend from the bottom of the housing and each has a central prong or pin 50 extending into the bore 46. Each bore 46 also has a tapered surface 51. A plurality of clamping or compressing collars 52 each has a generally cylindrical portion 53 and a plurality of fingers 54 spaced by a plurality of slots 55 and which may be at an angle to the cylindrical portion 53. Each collar 52 is inserted into one tapered portion 51 of the bore 46 and the cover 38 is partially attached with the screws 40 to the housing. Each conductor 36 can then be inserted through the cover openings 44 through the collars 52 where they will expand the fingers 54 and then be inserted into the bores 46 where the prongs 50 drive into the insulation and into the conductor in the center thereof. The collars 52 can be made of an inexpensive insulating polymer material which allows the expansion of the fingers 54. Once each wire is inserted, the screws 40 can be tightened down driving each collar 52 pushing against the top edge 56 which drives the fingers 54 against the tapered surface 51 to compress the fingers directly against the outer insulation 42 of each conductor 36, thus clamping all of a plurality of individual insulated conductors 36 simultaneously.

Figure 7:
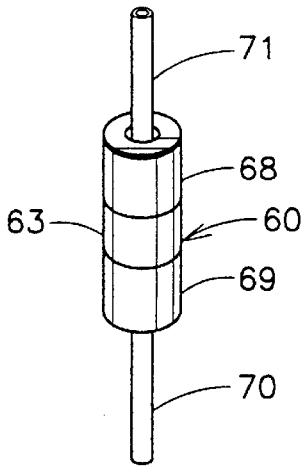
FIG. 7 is a perspective view of an electrical connector for connecting to wires in series.
Figure 8:
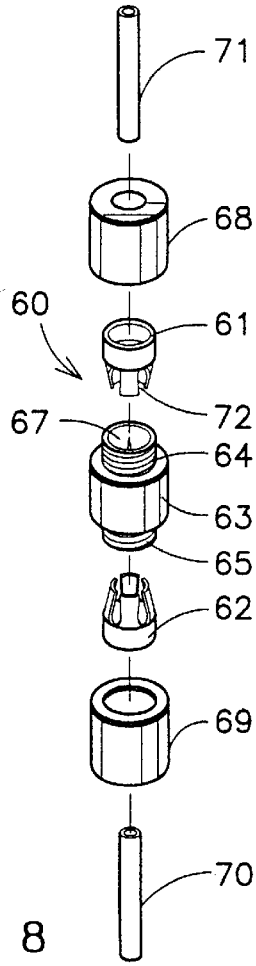
FIG. 8 is an exploded perspective of the connector of FIG. 7.

Turning to FIGS. 7 and 8, an electrical conductor 60 uses the collars 61 and 62, which are the same as the collars 52 in FIGS. 5 and 6. In this embodiment, a central housing 63 has external threads 64 on one side and external threads 65 on the other side thereof. The center prong 66 extends all the way through the housing 63 and provides a prong on either side thereof in the bores 67. A threaded cap 68 and 69 are threaded onto the housing 63 threads 64 and 65 against the collars 61 and 62 and a pair of conductors 70 and 71 are slid therein expanding the fingers 72 of each collar while driving the insulated wire 70 and 71 into the prong 66 which are then tightened against the tapered surface within each side of the housing 63 to connect a conductor 70 and 71 together. This is accomplished without stripping either wire and merely sticking a wire in each end and tightening two caps.

Figure 9:
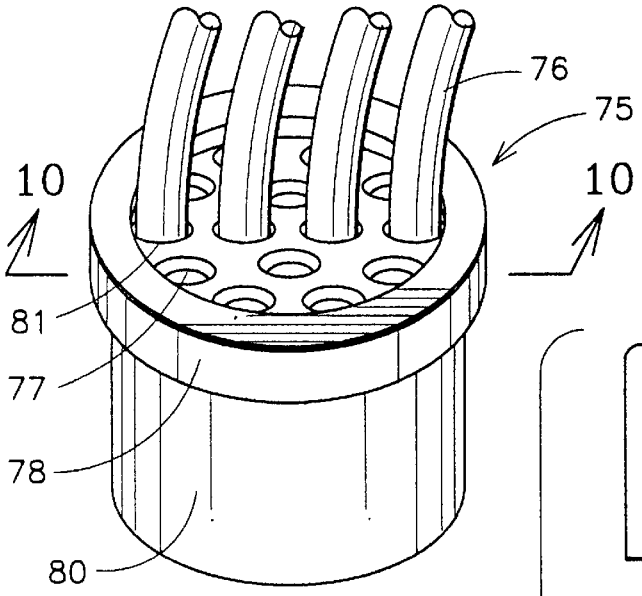
FIG. 9 is a perspective view of another connector for connecting a plurality of electrical conductors thereto.
Figure 10:
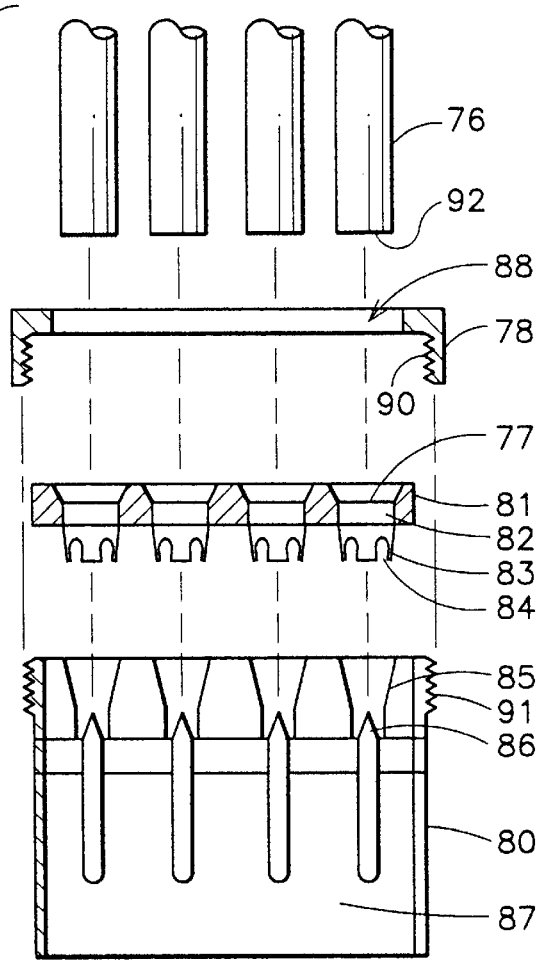
FIG. 10 is an exploded sectional view taken on the line 10—10 of FIG. 9.

Turning to FIGS. 9 and 10, an electrical connector 75 has a plurality of insulated electrical conductors 76 extending thereinto through a plurality of openings 77 within a cover 81 attached to a housing 80 with a threaded open cap 78. The cap 78 fits over the cover member 81 which has a plurality of collars 82 built thereinto, as seen in FIG. 10. Each collar 82 has a plurality of flexible fingers 83 spaced by a plurality of slots 84. The housing 80 has a plurality of tapered openings 85 therein, each having a prong or center pin 86 extending thereinto and then extending into the hollow housing portion 87. In operation, the cap portion 78, which has an open center portion 88 and internal threads 90, is threaded onto the external threads 91 on the housing 80 driving the multiple collar member 81 into the tapered bores 85. Once the cap 78 is loosely attached, each of the electrical conductors 76 having the ends 92 smoothly cut off and inserted through an openings 77 spreading the fingers 83 of each collar, are pushed onto an electrical conducting prong 86. The threaded cap 78 is then tightened to drive all of the angled fingers 83 of the collars 82 against the tapered opening 85 and into each of the conductors 76 extending therethrough to clamp and hold each of the conductors 76 simultaneously.

Figure 11:
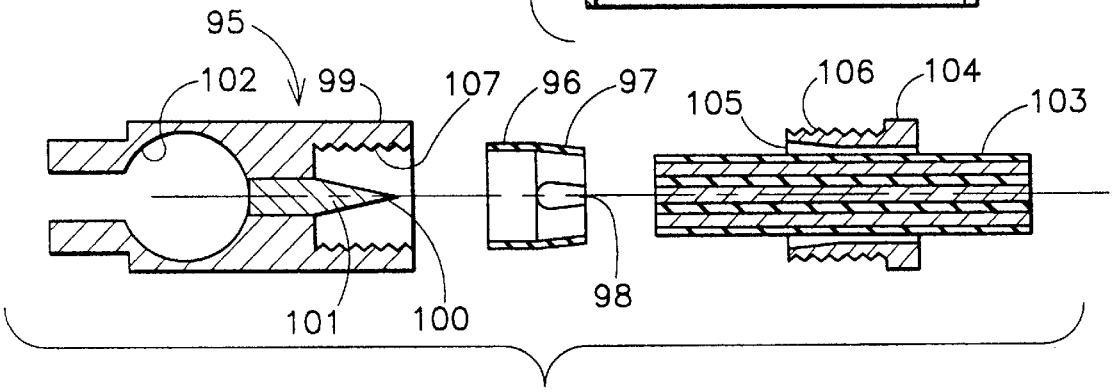
FIG. 11 is an exploded sectional view of an electrical battery terminal connector in accordance with the present invention.

Turning to FIG. 11, another embodiment of the present invention shows a battery electrical connector 95 having a collar 96 similar to the collar 52 of FIG. 6 having a plurality of flexible or ductile fingers 97 separated by a plurality of slots 98. The connector housing 99 has a bore 100 therein with a prong 101 extending into the bore and also has a battery terminal opening 102 which can be clamped onto a battery terminal. The collars 96 are inserted into the bore 100 electrical conductor 103 is inserted through the collar onto the prong 101 and through the cap 104. The cap 104 has a tapered surface 105 therein which drives against the fingers 97 of the collar 96 when the cap 104 is threaded onto the internal threads 107 in the bore 100 of the connector housing 99.

It should be clear at this time that an electrical connector uses a common compression cover for connecting a plurality of conductors simultaneously or for connecting a single conductor to certain types of terminals. The electrical connector allows a rapid connection of an insulated wire end without stripping the wire or tinning the end of the wire and which leaves a fully insulated connector which can be rapidly attached, released, and replaced and which can be used with a wide variety of wire sizes. It should, however, also be clear that the present invention is not to be limited to the forms shown which are to be considered illustrative rather than restrictive.

I claim:

1. An electrical connector for coupling to a plurality of insulated electrical conductors comprising:

a housing having a housing cover, said housing and cover having a plurality of bores therein, at least a portion of each bore being tapered;

a plurality of electrical conductive pointed prongs, one of said plurality of pointed prongs being attached to said housing in each said bore therein, said pointed prong having one end portion protruding axially into one said housing bore for receiving the end of an insulated electrical conductor;

attaching means for attaching said cover to said housing bore;

a plurality of compression collars, each having an opening extending axially therethrough for insertion of a wire therethrough, and each having a compression portion thereon for wedging into said housing tapered portion upon said cover being attached to said housing driving each said collar into the tapered portion of one said bore whereby placing a collar into each said housing bore and inserting a wire into each housing bore through the inserted collar and tightening the cover to said housing, clamps said collar onto a wire placed therein, whereby a plurality of insulated wires can be rapidly connected to an electrical connector without removing the insulation from the end of the wire.

2. An electrical connector for coupling to a plurality of insulated electrical conductors in accordance with claim 1 in which each said collar has an angled expandable and compressible portion which expands upon insertion of a wire therethrough and compresses onto an inserted wire when said housing cover is attached to said housing.

3. An electrical connector for coupling to a plurality of insulated electrical conductors in accordance with claim 1 in which each said collar has a plurality of angled fingers thereon and said housing cover has a plurality of bores therethrough, each said bore having said tapered portion therein to compress upon said collar fingers being wedged thereagainst.

4. An electrical connector for coupling to a plurality of insulated electrical conductors in accordance with claim 2 in which said collar has a plurality of split portion in the end thereof to form a plurality of segments which expand by the insertion of a wire and compress by the attaching of said cover to said housing.

5. An electrical connector for coupling to a plurality of insulated electrical conductors in accordance with claim 4 in which said collar is a one piece polymer collar.

6. An electrical connector for coupling to a plurality of insulated electrical conductors in accordance with claim 5 in which said housing has a generally cylindrical shape.

7. An electrical connector for coupling to a plurality of insulated electrical conductors in accordance with claim 5 in which said housing has a generally rectangular shape.

8. An electrical connector for coupling to a plurality of insulated electrical conductors comprising:

a housing having a plurality of bores therein, each said bore having a tapered portion therein;

a plurality of electrical conductive center pins attached to said housing and each said center pin extending into one said housing bore for receiving the end of an insulated electrical conductor;

a housing cover removably attached to said housing and having a plurality of bores therethrough, each said bore having a plurality of compression collars therein, each sized to fit into one said housing bore and each said collar having a bore extending therethrough for insertion of a wire therein, and each said collar having a compressible portion compressible upon driving said collar into one said housing bore tapered portion to drive said compressional portion against a wire inserted therein; and a housing cover attaching cap covering a portion of said housing cover and removably attached to said housing for compressing said cover onto said housing;

whereby placing said collar into said bore clamps said collar onto a wire placed therein.

9. An electrical connector for coupling to a plurality of insulated electrical conductors in accordance with claim 8 in which each said collar bore has tapered fingers and is sized to accept difference size wires.

10. An electrical connector for coupling to a plurality of insulated electrical conductors in accordance with claim 8 in which each said collar has an expandable and compressible portion which expands upon insertion of a wire through said collar bore and compresses onto an inserted wire when said collar is driven into said housing.

11. An electrical connector for coupling to a plurality of insulated electrical conductors in accordance with claim 10 in which each said collar has a plurality of splits in the end thereof to form a plurality of collar segments which expand by the insertion of a wire therethrough and compressed by driving said segments into a housing tapered portion.

12. An electrical connector for coupling to a plurality of insulated electrical conductors in accordance with claim 8 in which said housing is a generally cylindrical in shape.

13. An electrical connector for coupling to an insulated electrical conductor comprising:

a housing having a bore therein;

a housing cap removably attached to said housing and having a bore therethrough, said cap bore having a tapered portion therein, and being aligned with said housing bore when said housing cap is attached to said housing;

an electrical conductive center pin attached to said housing and extending into said housing bore for receiving the end of an insulated electrical conductor;

a compression collar sized to fit into said housing bore and said cap having an angled compressible portion compressible upon driving said collar into said housing cover bore tapered portion to drive said compression collar against a wire inserted therein whereby placing an insulated wire through said cap into said housing bore and through said collar and tightening said cap clamps said collar onto the wire, whereby a wire can be rapidly connected to an electrical connector.

14. An electrical connector for coupling to an insulated electrical conductors in accordance with claim 13 in which said housing has two collar bores therein, each having a conductive center pin extending thereinto and has a pair of compression collars for attaching two wires to said connector.

15. An electrical connector for coupling to an insulated electrical conductors in accordance with claim 14 in which said collar has an expandable and compressible portion which expands upon insertion of a wire through said collar bore and compresses onto an inserted wire when said collar is driven into said housing.

16. An electrical connector for coupling to an insulated electrical conductors in accordance with claim 14 in which said collar has a plurality of fingers on the end thereof which expand by the insertion of a wire therethrough and compress by driving said segments into a housing tapered portion.

17. An electrical connector for coupling to an insulated electrical conductors in accordance with claim 13 in which said housing is a battery terminal.

18. An electrical connector for coupling to an insulated electrical conductors in accordance with claim 15 in which said collar is a one piece polymer collar.

19. An electrical connector for coupling to a plurality of insulated electrical conductors in accordance with claim 15 in which said housing is a generally cylindrical in shape.

20. An electrical connector for coupling to an insulated electrical conductor comprising:

a housing having a bore therein;

a housing cap removably attached to said housing and having a bore therethrough for accepting an electrical connector;

an electrically conductive center pin attached to said housing and extending into said housing bore for engaging the end of an electrical conductor;

one bore of the bore in said housing and of the bore in said housing cap having a tapered portion and the other bore having a flat end wall; and a compression collar sized internally to receive an insulated electrical conductor and having an angled slotted exterior end portion sized for a wedging fit with the tapered portion of said one bore and having a flat face portion at the other end for engaging the flat end wall of said bore;

whereby upon inserting an insulated electrical conductor through said housing cap and through said compression collar oriented with its angled end facing said one bore and into engagement with said center pin, and upon attaching said housing cap to said housing, the flat end wall of said other bore engages the flat face portion of said compression collar forcing the compression collar at its angled end portion into wedging engagement with the tapered portion of said one bore thereby causing the compression collar to clamp onto the insulation surface of the electrical conductor.

21. The electrical connector of claim 20 wherein the bore in said housing has a tapered portion and the bore in the housing cap has a flat end wall.

22. The electrical connector of claim 21 wherein the housing has a plurality of bores provided with corresponding plurality of center pins and wherein the housing cap has a corresponding plurality of bores for accepting a plurality of electrical conductors, and a corresponding plurality of compression collars are provided for clamping onto the electrical conductors when the housing cap is attached to the housing.

23. The electrical connector of claim 20 wherein the bore in said housing cap has the tapered portion and the bore in the housing has the flat end wall.

24. The electrical connector of claim 21 wherein the housing has a plurality of bores provided with corresponding plurality of center pins, and wherein a corresponding plurality of compression collars are provided for clamping onto a plurality of electrical conductors when the housing cap is attached to the housing, said plurality of compression collars being combined into a unitary cover member having a flat face for engaging the flat end wall of the housing cap.

* * * * *